US006621383B2

(12) United States Patent
Nakamura et al.

(10) Patent No.: US 6,621,383 B2
(45) Date of Patent: Sep. 16, 2003

(54) DIELECTRIC FILTER, DIELECTRIC DUPLEXER, AND COMMUNICATION DEVICE

(75) Inventors: Soichi Nakamura, Kanazawa (JP); Kyoji Matsunaga, Kanazawa (JP); Hirofumi Miyamoto, Kanazawa (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 10/098,894

(22) Filed: Mar. 15, 2002

(65) Prior Publication Data

US 2002/0149442 A1 Oct. 17, 2002

(30) Foreign Application Priority Data

Mar. 16, 2001 (JP) ..... 2001-076378
Jan. 11, 2002 (JP) ..... 2002-004918

(51) Int. Cl.[7] ..... H01P 1/202
(52) U.S. Cl. ..... 333/206; 333/134
(58) Field of Search ..... 333/134, 202, 333/206, 207, 222

(56) References Cited

U.S. PATENT DOCUMENTS 5,157,365 A * 10/1992 Hoang ..... 333/206
5,327,108 A * 7/1994 Hoang et al. ..... 333/203
5,517,162 A * 5/1996 Ariyoshi ..... 333/222
5,864,263 A * 1/1999 Takimoto et al. ..... 333/202
6,087,909 A * 7/2000 Toda et al. ..... 333/134

FOREIGN PATENT DOCUMENTS

JP 04103202 A * 4/1992 ..... H01P/1/205

* cited by examiner

*Primary Examiner*—Seungsook Ham
(74) *Attorney, Agent, or Firm*—Dickstein, Shapiro, Morin & Oshinsky, LLP

(57) ABSTRACT

A dielectric filter includes a dielectric block having a plurality of outer surfaces including opposed top and bottom surfaces, opposed side surfaces and a mounting surface. A plurality of through holes extend between the opposed top and bottom surfaces. Respective internal electrodes are located on internal surfaces of the through holes and an outer conductor is formed on at least some of the outer surfaces. First input output electrode extends from the mounting surface to one of the side surfaces. A second input output electrode extends from the mounting surface to the other of the side surfaces. Each of the first and second input output electrodes are separated from the outer conductor by a respective conductor-free portion wherein at least one corner of an outer shape of each of the conductor-free portions is formed as a continuous line having no right angles.

20 Claims, 7 Drawing Sheets

| | ODD MODE | EVEN MODE | Qe |
|---|---|---|---|
| ① RELATED PRODUCT | 165.4 | 146.9 | 28.7 |
| ② PRODUCT OF THE PRESENT INVENTION | 177.7 | 155.4 | 28.9 |
| ③ INCREASE OF Qo | 7.4% | 5.8% | —— |

DIELECTRIC FILTER, DIELECTRIC DUPLEXER, AND COMMUNICATION DEVICE

BACKGROUND OF THE INVENTION

1. Field of the Invention

The present invention relates to dielectric filters, dielectric duplexers, and communication devices which are mainly used in the microwave band.

2. Description of the Related Art

A related dielectric filter using a dielectric block substantially in the form of a rectangular solid is described with reference to the perspective view of FIG. 9.

A pair of through holes 2*a*, 2*b* are formed in the dielectric block. Internal conductors 3*a* and 3*b* are formed on the internal surfaces of the through holes 2*a*, 2*b* to form resonator cavities. An external conductor 5 is formed on the outer surface of the dielectric block 1. Furthermore, conductor-free portions 4*a* and 4*b* are provided in the vicinity of one open end surface of each of the resonator cavities to form open ends. The other ends of the resonator cavities are short-circuited to the external conductor 5. Input-output electrodes 6*a* and 6*b* are formed so as to be coupled with the open ends of the resonator cavities. The outer periphery of the input-output electrodes are defined by conductor-free portions 7*a* and 7*b* that extend from the mounting surface of the dielectric block to the opposite end surfaces which extend parallel to the linear direction of the resonator cavities thereof. A complete dielectric filter is thus constructed.

However, in the related dielectric filter using such a dielectric block, the following problem occurs.

In the related dielectric filter, the input-output electrodes 6*a* and 6*b* and the conductor-free portions 7*a* and 7*b* are formed with square shapes which extend from the mounting surface to the side surfaces. That is, the outer shapes of the input-output electrodes 6*a* and 6*b* and the external-conductor-free portions 7*a* and 7*b* are formed by lines meeting at right angles.

As a result, as shown in FIG. 10, current is concentrated in the vicinity of the input-output electrodes 6*a* and 6*b* and the conductor-free portions 7*a* and 7*b*, and accordingly conductor loss is high. Therefore, the unloaded Q factor of the dielectric filter deteriorates and the insertion loss and attenuation characteristics worsen.

SUMMARY OF THE INVENTION

It is an object of the present invention to construct a dielectric filter and dielectric duplexer using a dielectric block having reduced conductor loss caused by concentration of a current in the external conductor of the dielectric block and having a high unloaded Q factor, and a communication device using the dielectric filter and dielectric duplexer.

The invention includes a dielectric filter, comprising:

a dielectric block having a plurality of outer surfaces including opposed top and bottom surfaces, opposed side surfaces and a mounting surface, the dielectric block also having a plurality of through holes extending between the opposed top and bottom surfaces;

respective internal electrodes located on internal surfaces of the through holes;

an outer conductor formed on at least some of the outer surfaces; and first and second input-output electrodes formed on the outer surfaces, the first input-output electrode extending from the mounting surface to one of the side surfaces, the second input-output electrode extending from the mounting surface to the other of the side surfaces, each of the first and second input-output electrodes being separated from the outer conductor by a respective conductor-free portion wherein at least one corner portion of an outer shape of each of the conductor-free portions is formed as a continuous line having no right angles.

Furthermore, according to a preferred embodiment of the present invention, a dielectric filter is constructed such that at least one corner portion of each of the outer shape and inner shape of the external-conductor-free portions is formed as a continuous line having no right angle.

Furthermore, according to the present invention, a dielectric duplexer is constructed by using the dielectric filter.

Furthermore, according to the present invention, a communication device is constructed by using the dielectric filter or dielectric duplexer.

DESCRIPTION OF THE PREFERRED EMBODIMENTS

The construction of a dielectric filter according to a first embodiment of the present invention is described with reference to FIGS. 1 to 4.

A parallelpiped dielectric block 1 includes a pair of through holes 2*a* and 2*b* extending from the top to the bottom surface of the dielectric block. Internal conductors 3*a* and 3*b* are formed on respective internal surfaces of the through holes 2*a* and 2*b* to form respective resonator cavities. Conductor-free portions 4*a* and 4*b* are formed in the inner surfaces of the through holes to form open ends of the resonator cavities. An external conductor 5 is formed on the outer surfaces of the dielectric block, as are input-output electrodes 6*a* and 6*b*. The input-output elctrodes are electrically isolated from the external conductor 5 by respective conductor-free portions 7*a* and 7*b*. As a result of this structure, a coupling capacitance Ca is formed between an internal conductor and an input-output electrode (FIG. 3), and a coupling capacitance Cb is formed between an external conductor (grounding electrode) and an input-output electrode.

The conductor-free portions 7*a* and 7*b* extend from the mounting surface of the dielectric block to the side surfaces which extend parallel to the axial direction of the through holes 2*a* and 2*b* to define input-output electrodes 6*a* and 6*b* which are capacitively coupled with the open end of the resonator cavities. In this way, a complete dielectric filter is constructed. The outer shape of each of the conductor-free portions 7*a* and 7*b* is defined by a continuous line which does not contain any corner portion forming a right angle.

With this construction the concentration of current generated on the surface of the external conductor 5 (e.g., between the conductor-free portions 7*a* and 7*b*) can be suppressed. Therefore, conductor loss caused in the external conductor is suppressed and degradation of the unloaded Q factor can be reduced.

Here, the degree of external coupling in the dielectric filter is dependent on the coupling capacitance Ca between the input-output electrode and the internal conductor and the coupling capacitance Cb between the input-output electrode and the external conductor. Ca has a particularly strong effect on the external coupling capacitance.

Since the dielectric filter shown in the present embodiment has the same input-output electrode shape as that of the related dielectric filter, the coupling capacitance Ca between the internal conductor and the input-output electrode is the same as the coupling capacitance in the related art. Furthermore, the area of the input-output electrode does not change. Rather, the area of the conductor-free portion is reduced. Accordingly the coupling capacitance Cb between the external conductor, as a grounding electrode, and the input-output electrode is almost the same as that of the related art.

Figures 4A, 4B:
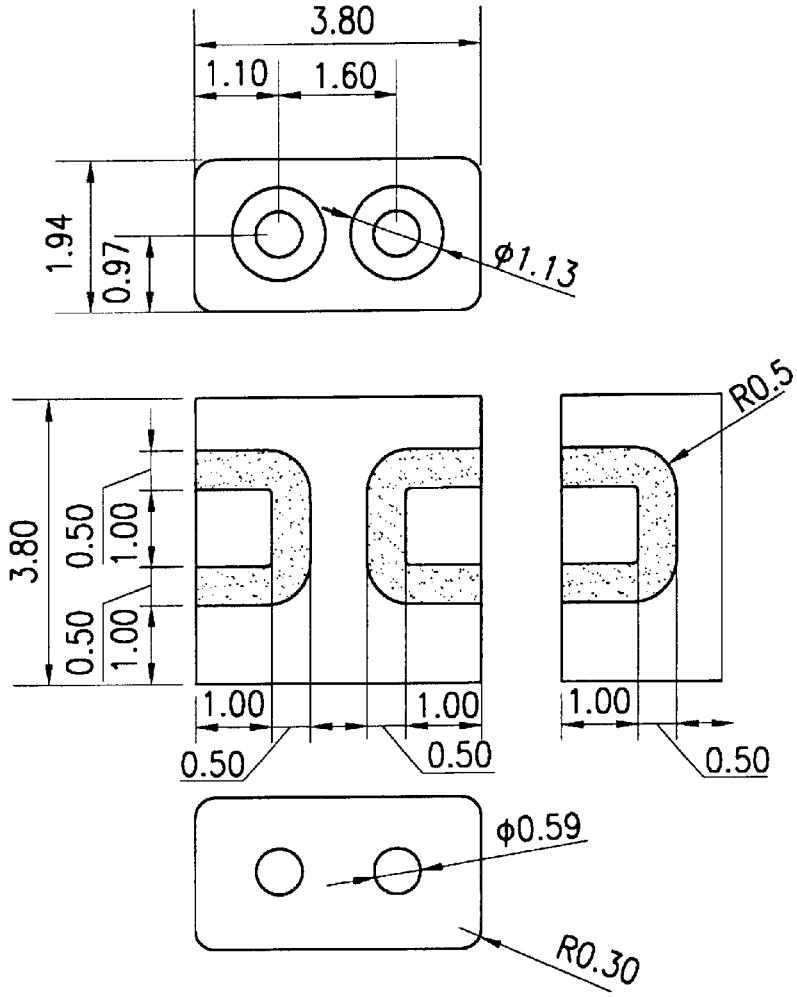
FIG. 4A shows the dimensions of the dielectric filter in FIG. 1.
FIG. 4B show the Q factors of the dielectric filter in FIG. 1

FIG. 4A shows exemplary dimensions of a dielectric filter according to the present embodiment. FIG. 4B shows exemplary characteristics thereof.

As shown in FIG. 4B, in the preferred embodiment of the dielectric filter of the present invention, the unloaded Q factor ($Q_0$) is improved by 7.4% in the odd mode and by 5.8% in the even mode without substantially changing the external coupling Qe. Therefore, when constructed in this way, it is possible to construct a dielectric filter in which the unloaded Q factor is improved without significantly affecting the degree of external coupling.

Next, the construction of a dielectric filter according to a second embodiment of the present invention is described with reference to FIG. 5.

Figure 5:
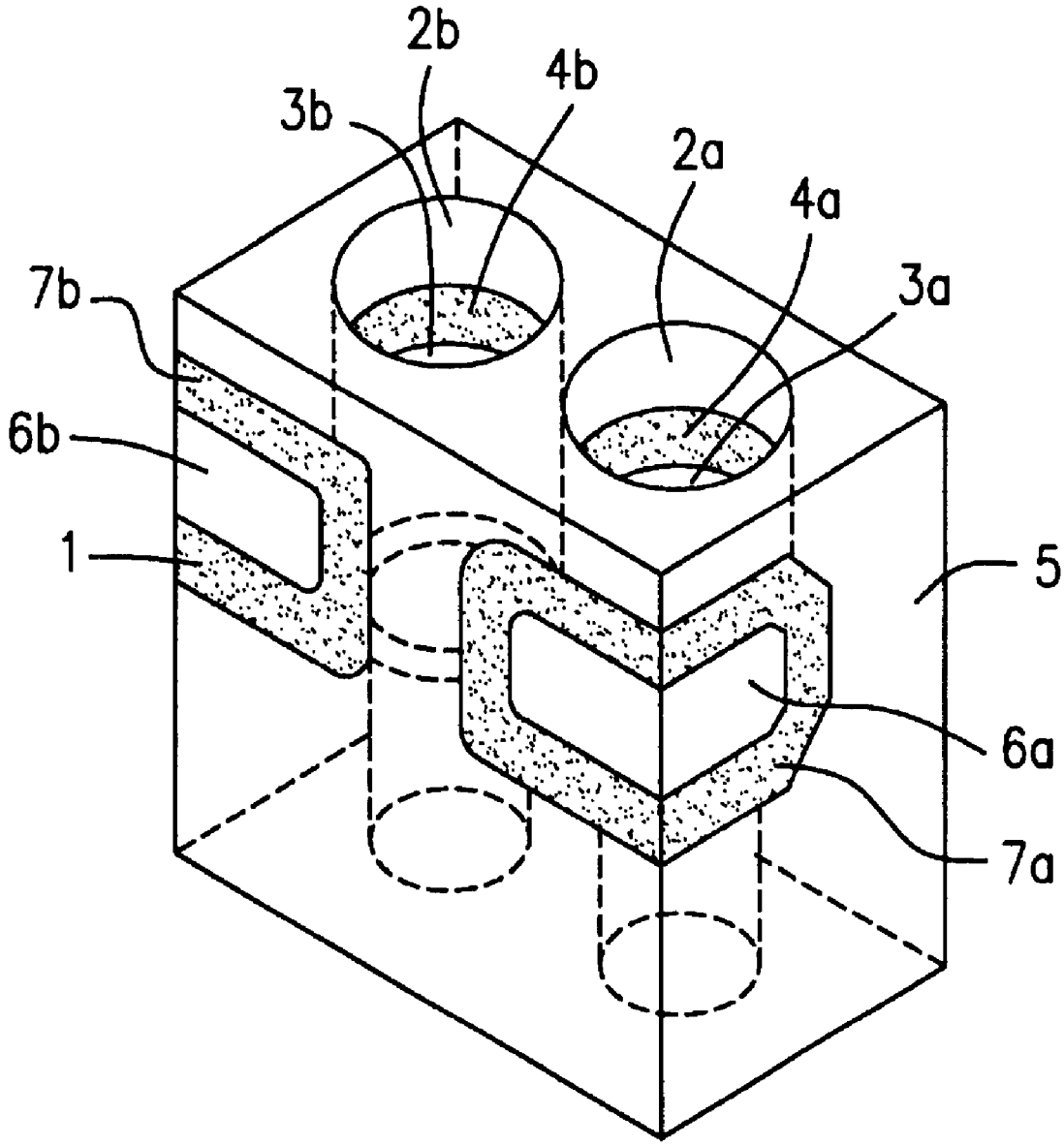
FIG. 5 is a perspective view of a dielectric filter according to a second embodiment of the present invention.

In the dielectric filter shown in FIG. 5, the outer shape of the input-output electrodes 6*a* and 6*b* (that is, the inner shape of the conductor-free portions 7*a* and 7*b*) constitutes a continuous line which does not contain any corner portion forming a right angle. The remaining construction of this embodiment is the same as the dielectric filter according to the first embodiment of the present invention (the filter shown in FIG. 1).

Thus, when the outer shape is changed, and simultaneously the inner shape is changed in accordance with the outer shape, the space between the input-output electrodes 6*a* and 6*b* and the external conductor 5 can be made substantially uniform. Accordingly, the distribution of capacitance generated between the input-output electrodes 6*a* and 6*b* and the external conductor 5 can be made constant. Moreover, when the external conductor is cut using a cutter having the same width as the conductor-free portions 7*a* and 7*b*, the inner shape can be easily formed in accordance with the outer shape.

Figure 6A:
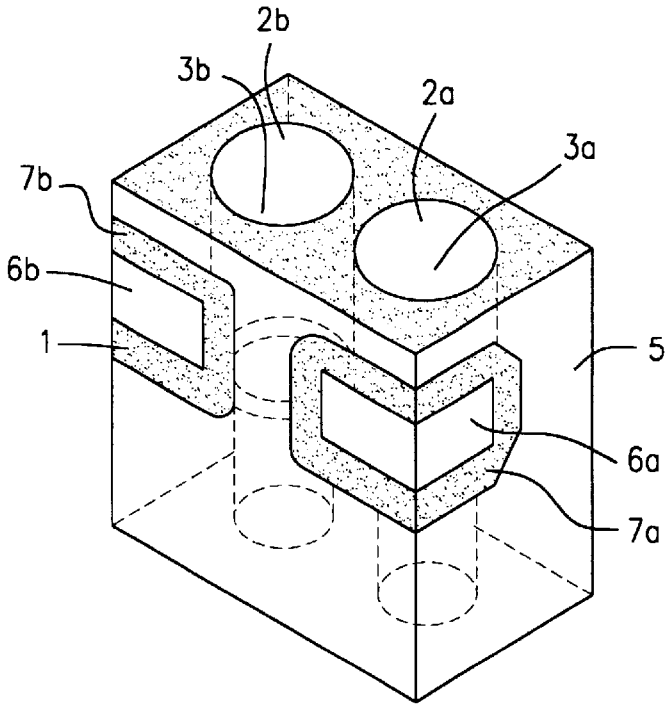
FIG. 6A is a perspective view of another dielectric filter having another construction.
Figure 6B:
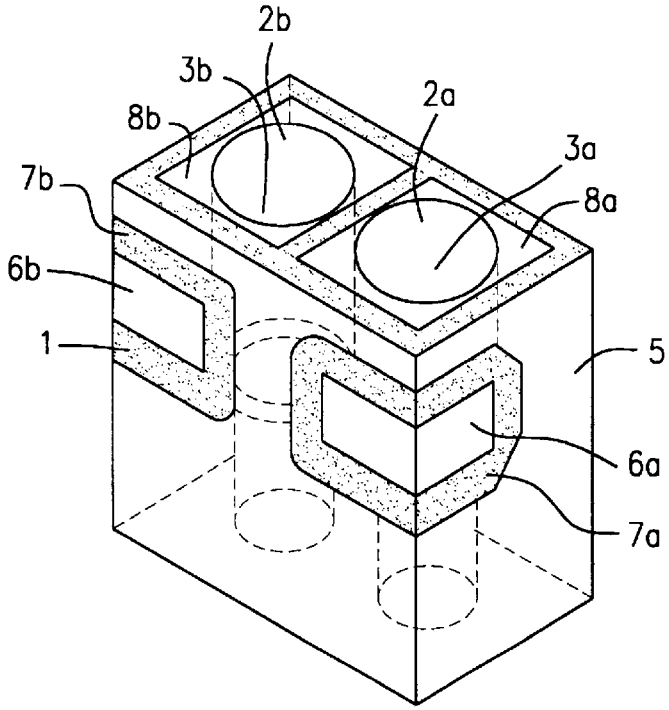
FIG. 6B is a perspective view of another dielectric filter having another construction.
Figure 7:
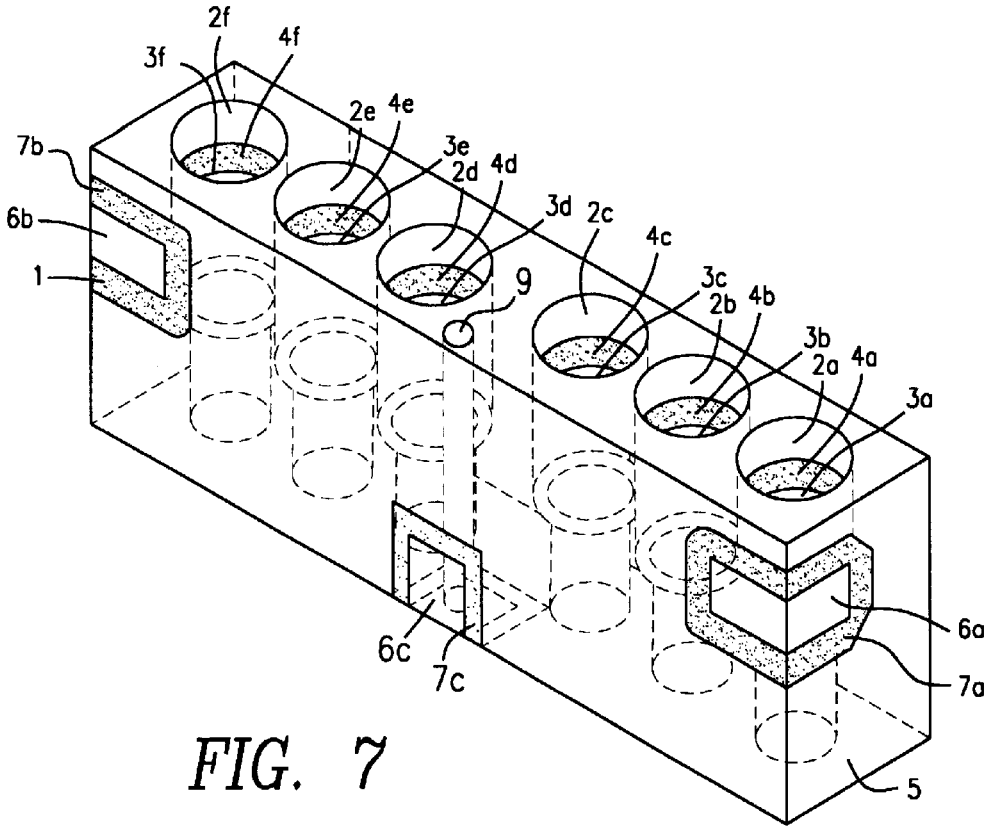
FIG. 7 is a perspective view of a dielectric duplexer.

Moreover, in a dielectric filter and a dielectric duplexer shown in FIGS. 6A, 6B, and 7, the unloaded Q factor can be improved in the same way as in the dielectric filters in the first and second embodiments.

FIG. 6A shows a dielectric filter in which one opening surface (the upper surface in the drawing) of the through holes 2*a* and 2*b* is an open end face where there is no electrode, and FIG. 6B shows a dielectric filter in which coupling electrodes 8*a* and 8*b*, generating capacitance between the open ends of the neighboring internal conductors 3*a* and 3*b*, are formed in one open surface of the through holes 2*a* and 2*b*.

Furthermore, FIG. 7 shows a dielectric duplexer in which a transmission filter and a reception filter, each having a three-stage dielectric resonator, are provided and an antenna excitation hole 9 and an input-output electrode 6*c* are formed between the filters.

Furthermore, in the dielectric filter and dielectric duplexer, the cross-section of the internal-conductor-formed holes may be not only circular, but also elliptical, polygonal, etc.

Next, the construction of a communication device according to a third embodiment of the present invention is described with reference to FIG. 8 which is a block diagram of the communication device.

Figure 8:
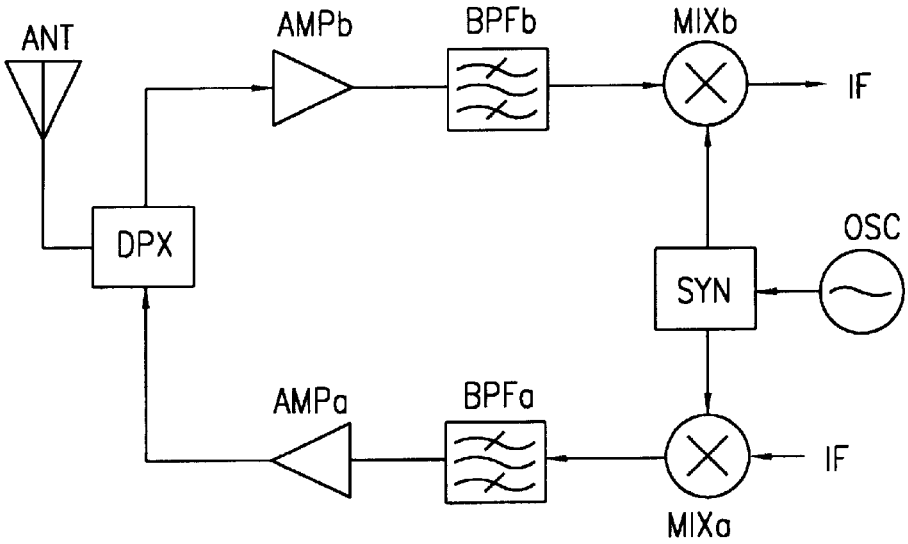
FIG. 8 shows a block diagram of a communication device according to a third embodiment of the present invention.
Figure 9:
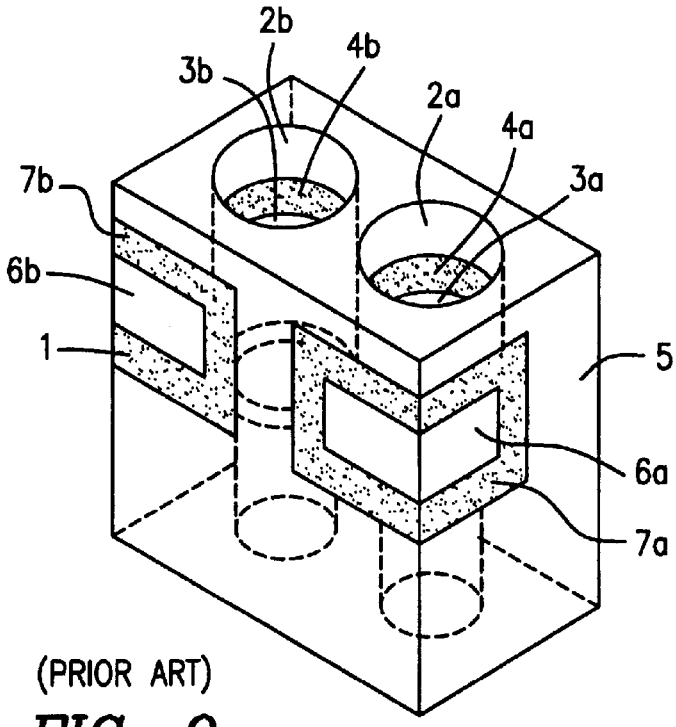
(PRIOR ART) FIG. 9
FIG. 9 is a perspective view of a related dielectric filter.
Figure 10:
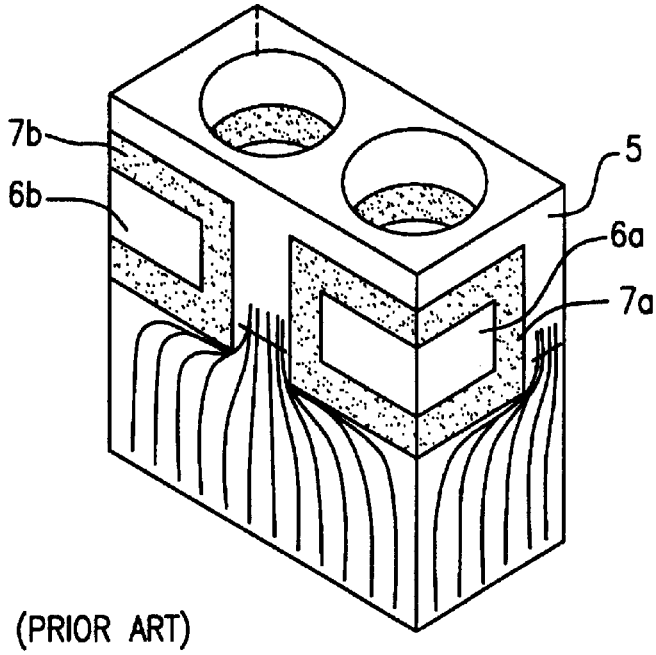
(PRIOR ART) FIG. 10
FIG. 10 shows the distribution of current flowing through the external conductor, which is generated in the related dielectric filter in FIG. 9.

In FIG. 8, a transmission-reception antenna ANT, a duplexer DPX, bandpass filters BPFa and BPFb, amplifiers AMPa and AMPb, mixers MIXa and MIXb, an oscillator OSC, and a synthesizer SYN are shown. The mixer MIXa modulates a frequency signal output from the synthesizer SYN by using an IF signal, the bandpass filter BPFa allows only transmission frequencies to pass there through, and the amplifier AMPa power amplifies and transmits the transmission frequencies through the antenna ANT. The amplifier AMPb amplifies a signal output from the duplexer DPX, and the bandpass filter BPFb allows only reception frequencies out of the signals from the amplifier AMPb to pass there through. The mixer MIXb mixes the frequency signal output from the synthesizer SYN and the reception signal to output an intermediate frequency signal IF.

Figure 1:
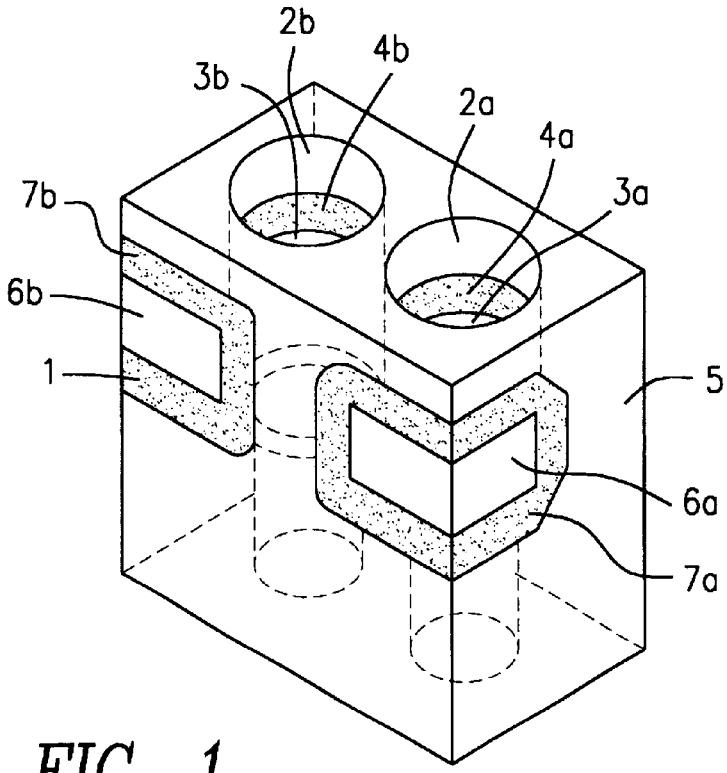
FIG. 1 is a perspective view of a dielectric filter according to a first embodiment of the present invention.
Figure 2:
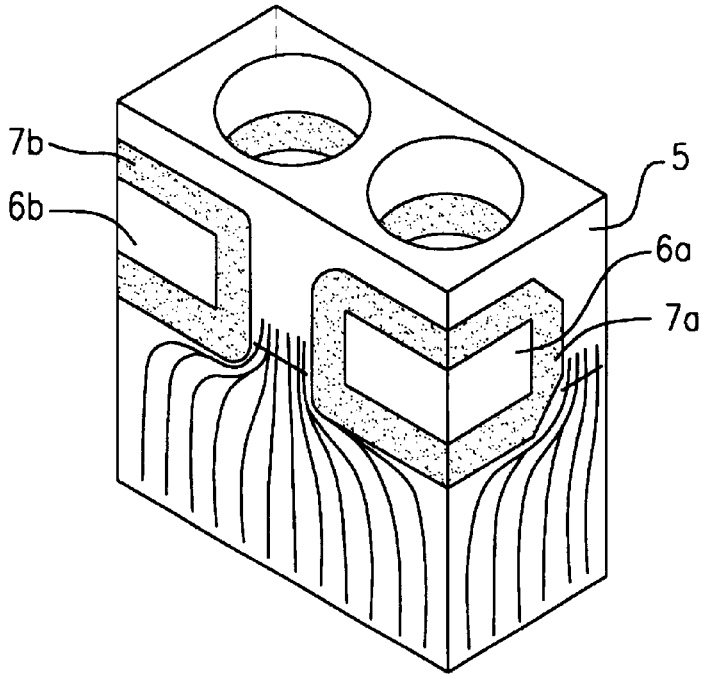
FIG. 2 shows the distribution of current flowing through the external conductor, which is generated in the dielectric filter in FIG. 1.
Figure 3:
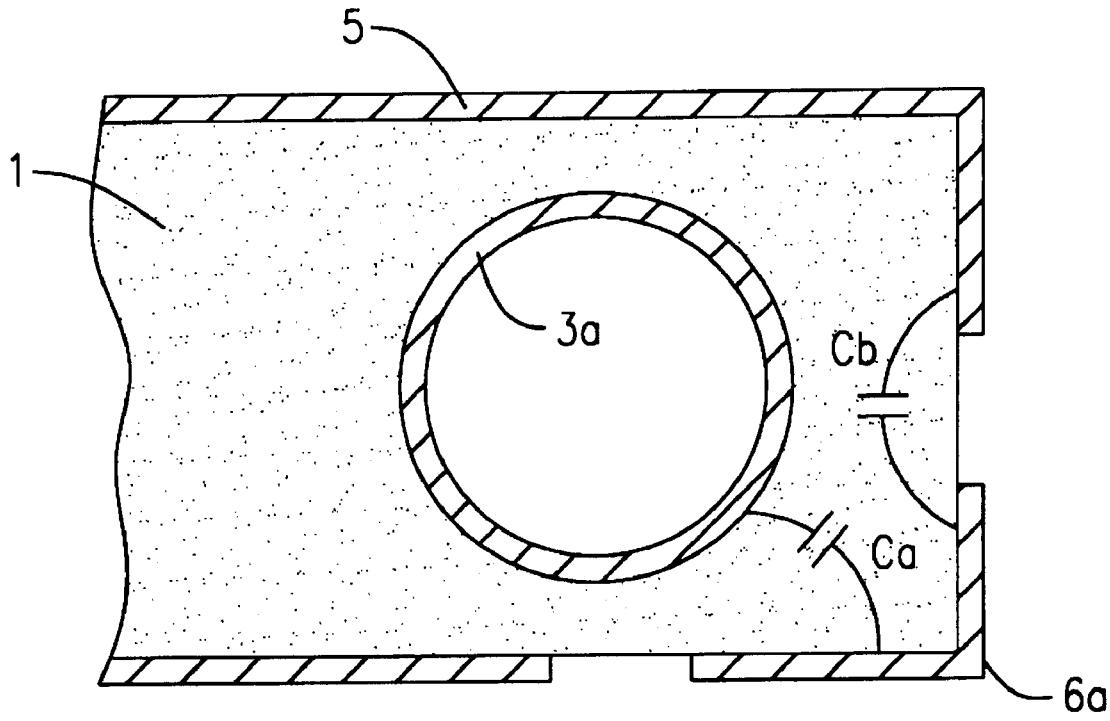
FIG. 3 is a sectional view of the dielectric filter in FIG. 1, which includes the vicinity of an input-output electrode.

The dielectric filters having the construction shown in FIGS. 1, 3, and 6 can be used in the bandpass filters BPFa and BPFb shown in FIG. 8. Furthermore, the dielectric duplexer shown in FIG. 7 can be used in the duplexer DPX. In this way, a smaller communication device having excellent communication characteristics can be constructed by using a small dielectric filter and dielectric duplexer in which the unloaded Q factor is improved.

According to the present invention, a dielectric filter having an improved unloaded Q factor can be constructed almost without substantially changing the degree of external coupling wherein a plurality of internal-conductor-formed holes, on the inner surface of which the internal conductor is formed, are provided inside a dielectric block substantially in the form of a rectangular solid so that the holes extend from one surface to the other surface, opposite surface of the dielectric block. An external conductor is formed on the outer surface of the dielectric block, and input-output electrodes are formed by providing conductor-free portions so as to extend from the mounting surface to the side surfaces which extend parallel to the axial direction of the through holes. At least one corner portion of the outer shape, on each surface, of the conductor-free portions is formed by using a continuous line having no right angle.

Furthermore, according to the present invention, a dielectric filter having an improved unloaded Q factor can be constructed such that the degree of external coupling can be adjusted with at least one corner portion of each of the outer shape and inner shape of the conductor-free portions formed by a continuous line having no right angle.

Furthermore, according to the present invention, a dielectric duplexer having an improved unloaded Q factor improved can be constructed by using the dielectric filter.

Furthermore, according to the present invention, a communication device having excellent communication characteristics can be constructed by using the dielectric filter or dielectric duplexer.

What is claimed is:

1. A dielectric filter, comprising:

a dielectric block having a plurality of outer surfaces including opposed top and bottom surfaces, opposed side surfaces and a mounting surface, the dielectric block also having a plurality of through holes extending between the opposed top and bottom surfaces;

respective internal electrodes located on internal surfaces of the through holes;

an outer conductor formed on at least some of the outer surfaces; and first and second input-output electrodes formed on the outer surfaces, the first input-output electrode extending from the mounting surface to one of the side surfaces, the second input-output electrode extending from the mounting surface to the other of the side surfaces, each of the first and second input-output electrodes being separated from the outer conductor by a respective conductor-free portion wherein at least one corner portion of an outer shape of each of the conductor-free portions is formed as a continuous line having no right angles to reduce conductor loss caused by concentration of a current in the outer conductor.

2. The dielectric filter of claim 1, wherein the side surfaces extend perpendicular to the top and bottom surfaces and the mounting surface extends perpendicular to both the top and bottom surfaces and the side surfaces.

3. The dielectric filter of claim 1, wherein each of the conductor-free portions totally surrounds its associated input-output electrode.

4. The dielectric filter of claim 1, wherein at least one corner portion of an inner shape of each of the conductor-free portions is formed as a continuous line having no right angles.

5. The dielectric filter of claim 1, wherein all of the corner portions of the outer shape of each of the conductor-free portions is formed as a continuous line having no right angles.

6. The dielectric filter of claim 5, wherein all of the corner portions of an inner shape of each of the conductor-free portions is formed as a continuous line having no right angles.

7. The dielectric filter of claim 4, wherein all of the corner portions of the inner shape of each of the conductor-free portions is formed as a continuous line having no right angles.

8. The dielectric filter of claim 1, wherein the at least one corner portion is round.

9. The dielectric filter of claim 1, wherein the at least one corner portion is beveled.

10. A dielectric duplexer containing a dielectric filter as claimed in claim 1.

11. A dielectric duplexer containing a dielectric filter as claimed in claim 2.

12. A dielectric duplexer containing a dielectric filter as claimed in claim 3.

13. A dielectric duplexer containing a dielectric filter as claimed in claim 4.

14. A dielectric duplexer containing a dielectric filter as claimed in claim 5.

15. A dielectric duplexer containing a dielectric filter as claimed in claim 6.

16. A dielectric duplexer containing a dielectric filter as claimed in claim 7.

17. A dielectric duplexer containing a dielectric filter as claimed in claim 8.

18. A dielectric duplexer containing a dielectric filter as claimed in claim 9.

19. A communication device containing a dielectric filter as claimed in claim 1.

20. A communication device containing a dielectric filter as claimed in claim 2.

* * * * *